US007513581B1

(12) United States Patent
Baiza et al.

(10) Patent No.: US 7,513,581 B1
(45) Date of Patent: Apr. 7, 2009

(54) CHASSIS LOCK FOR A DRAWER SLIDE

(75) Inventors: Julian S. Baiza, Arlington, TX (US); Huang Mushan, Singapore (SG); Wenming Yang, Singapore (SG); Meng Kee Koh, Singapore (SG)

(73) Assignee: Central Industrial Supply Company, Tucson, AZ (US)

( * ) Notice: Subject to any disclaimer, the term of this patent is extended or adjusted under 35 U.S.C. 154(b) by 97 days.

(21) Appl. No.: 11/810,906

(22) Filed: Jun. 7, 2007

(51) Int. Cl.
*A47B 88/04* (2006.01)

(52) U.S. Cl. ..... 312/333; 312/319.1

(58) Field of Classification Search ..... 312/330.1, 312/333, 334.1, 334.7, 334.8, 334.22, 334.44, 312/334.46, 334.47, 319.1, 319.2, 215, 222; 361/725, 726, 825; 211/26; 384/21, 22; 248/221.11, 221.12, 222.11; 292/304
See application file for complete search history.

(56) References Cited

U.S. PATENT DOCUMENTS

| | | | | |
|---|---|---|---|---|
| 516,583 | A | 3/1894 | Adkins | |
| 567,693 | A | 9/1896 | Smith | |
| 2,749,200 | A * | 6/1956 | Kuss | 312/323 |
| 4,423,914 | A | 1/1984 | Vander Ley | |
| 4,473,262 | A | 9/1984 | Staye | |
| 4,838,627 | A | 6/1989 | Macias | |
| 5,599,080 | A | 2/1997 | Ho | |
| 5,632,542 | A | 5/1997 | Krivec | |
| 5,683,159 | A | 11/1997 | Johnson | |
| 6,209,979 | B1 | 4/2001 | Fall et al. | |
| 6,601,933 | B1 * | 8/2003 | Greenwald | 312/333 |
| 6,626,300 | B2 | 9/2003 | Kaminski et al. | |
| 6,938,967 | B2 * | 9/2005 | Dubon et al. | 312/333 |
| 7,382,623 | B2 * | 6/2008 | Hartman | 361/726 |

* cited by examiner

*Primary Examiner*—James O Hansen
(74) *Attorney, Agent, or Firm*—Mark W Handley

(57) ABSTRACT

A chassis lock (32) for drawer slide (12) is provided by a slot (20) and a rotary lock member (34). The rotary lock member (34) has a disk-shaped body (36) with an arcuately shaped cutout portion defining a cam follower surface (38). A stop protuberance (42) extends from the rotary lock member (34) with opposite ends (47, 49) which locate the rotary lock member (34) in an open position and a closed position. A torsion spring (50) urges the rotary lock member (34) into the closed position. The weight of a drawer is applied through a mounting lug (30) to the cam follower surface (38), to move the rotary lock member (34) to the open position which aligns the cam follower surface (38) for passing the mounting lug (30) into a lock section (26) of the slot (20). When in the closed position, the disk-shaped portion (36) of the rotary lock member (34) prevents removal of the mounting lug (30) from within the lock section (26) of the slot (20).

18 Claims, 3 Drawing Sheets

CHASSIS LOCK FOR A DRAWER SLIDE

TECHNICAL FIELD OF THE INVENTION

The present invention relates in general to drawer slides, and in particular to a lock for securing a drawer to an inner member of drawer slide.

BACKGROUND OF THE INVENTION

Drawers have been secured to drawer slides by various methods, include using threaded fasteners to secure drawers to drawer slides. Some drawers have mounting lugs which extend from the drawers for fitting within receiving slots formed in the drawer slides. For the mounting lug and slot type drawer slides, locks have been provided for securing the mounting lugs within the slots to secure the drawer to the drawer slides.

SUMMARY OF THE INVENTION

A chassis lock for drawer slide is provided by forming a slot into drawer slide member, and providing a rotary lock member adjacent to the slot for moving between an open position and a closed position to determine whether a drawer mounting lug is retained within the slot. The rotary lock member preferably has a disk-shaped body into which an arcuately shaped cut out portion is formed to define a cam follower surface. A stop protuberance extends from an opposite end of the rotary lock member from that in which the cam follower surface is defined, and has a forward end defining a forward stop and a rearward end defining a rearward stop. A grip surface is provided by a castellated edge of the disk-shaped body and the stop protuberance. A recess is formed into an inner surface of the rotary lock member for receiving a torsion spring. The torsion spring engages between the rotary lock member and the drawer slide member for urging the rotary lock member into the closed position. The rotary lock member is rotatably mounted to the drawer slide member adjacent to the slot and the slot is configured such that when the weight of a drawer is applied through the mounting lug to the cam follower surface of the rotary lock member, the rotary lock member is moved to the open position and the can follower surface is aligned for passing the mounting lug into a lock section of the slot. When in the closed position, the disk-shaped portion of the rotary lock member prevents removal of the mounting lug from within the lock section of the slot. Opposite ends of the stop protuberance engage the drawer slide member to locate the rotary lock member in the open position and the closed position.

DESCRIPTION OF THE DRAWINGS

For a more complete understanding of the present invention and the advantages thereof, reference is now made to the following description taken in conjunction with the accompanying Drawings in which

FIG. 1 is a partial side elevation view of the drawer slide and the drawer lock, with the rotary lock member disposed for passing the drawer mounting lug into a J-shaped slot in the drawer slide;

FIG. 2 is a partial perspective view of a forward end of the drawer slide, and shows the rotary lock member of the drawer lock securing the drawer mounting lug to the drawer slide;

FIG. 3 is an exploded, partial perspective view of outward sides of the drawer lock and the forward end of the drawer slide;

FIG. 4 is an exploded, partial perspective view of inward sides of the drawer lock and the forward portion of the drawer slide;

FIG. 5 is a side elevation view of the rotary lock member and the drawer mounting lug;

FIG. 6 is a partial side elevation view of the first slide member and the drawer lock, showing the rotary lock member in a closed position and the drawer mounting lug moving through an entrance section in the J-shaped slot and into engagement with the rotary lock member;

FIG. 7 is a partial side elevation view of the first slide member and the drawer lock, showing the rotary lock member in an open position and drawer mounting lug engaging the rotary lock member in moving from a guide section to a lock section of the J-slot; and FIG. 8 is a partial side elevation view of the first slide member and the drawer lock, showing the drawer mounting lug located in the lock section of the J-slot and the rotary lock member in a closed position for securing the drawer mounting lug to the first slide member.

DETAILED DESCRIPTION OF THE INVENTION

Figure 1:
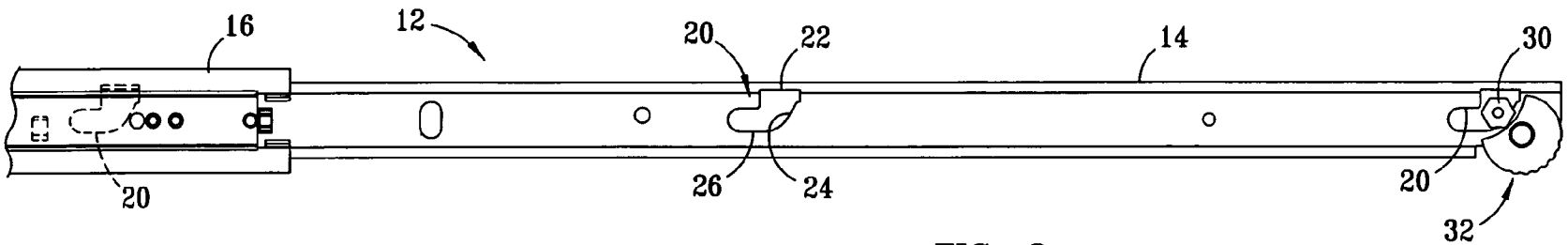
FIGS. 1 through 8 show various aspects for a drawer slide having a drawer lock with a rotary lock member for securing a drawer mounting lug to the drawer slide according to the present invention, as set forth below.

FIG. 1 is a partial side elevation view of a drawer slide 12 having a first slide member 14 and a second slide member 16. In some embodiments, the drawer slide 12 may include more than two slide members, such as a cabinet member (not shown). The first slide member 14 is slidably extensible from within the second slide member 16 for supporting a drawer (not shown) in a cantilevered arrangement. The first slide member 14 is shown after moving outward from within the second slide member 16 to a fully extended position. Three slots 20 are provided in the sidewall of the first slide member 14, spaced apart along the length of the first slide member 14. A first slot 20 is located at a forward end portion of the first slide member 14, a second slot 20 is located in an intermediate portion the first slide member 14, and a third slot 20 is located at a rearward end portion of the first slide member 14. The third slot 20 is shown located at a forward end of the second slide member 16. The three slots 20 are preferably J-shaped slots, each having an entrance section 22, a guide section 24 and a lock section 26. The entrance section 22 is located at an upper edge of the sidewall of the first slide member 14, and extends into the guide section 24. The guide section 24 is located in a central portion of the sidewall of the first slide member 14, and extends from the entrance section 22 to the lock section 26. The lock section 26 is located in a central portion of the sidewall of the first slide member 14, and extends horizontally, parallel to the length of the first slide member 14. The slots 20 are provided for receiving mounting lugs 30 (one shown) which provide drawer mounting members. One of the mounting lugs 30 is shown in the forward slot 20, located in the guide section 24 of the forward slot 20. The mounting lugs 30 extend from a drawer (not shown) for locating within lock sections 24 of the slots 20 to secure the drawer in fixed relation to the first slide member 14. When disposed in the lock section 24 of the slot 20, the mounting lug 30 can only slide forward and rearward relative to the length of the first slide member 14, and cannot be moved vertically.

Figure 2:
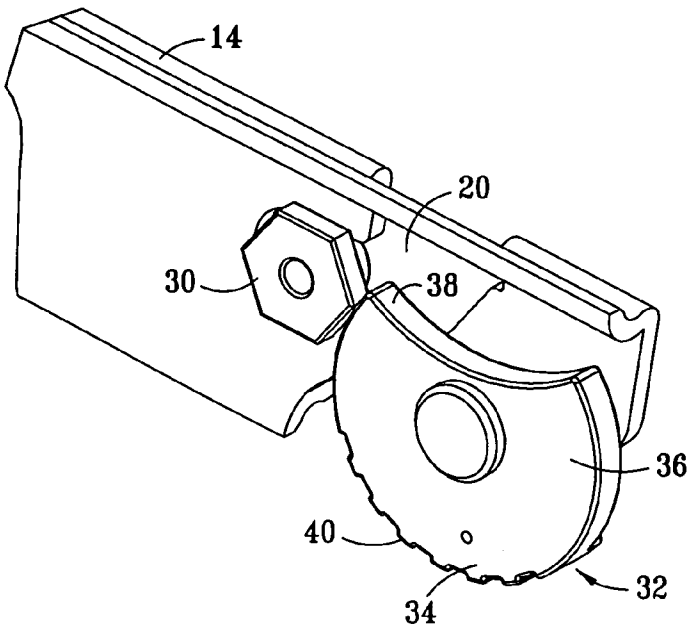

A drawer lock 32 includes a rotary lock member 34 which is rotatably mounted to the forward end of the first slide member 14 for moving between an open position shown in FIG. 1 and a closed position shown in FIG. 2. When the rotary lock member 34 is located in the open position shown in FIG.

1, the mounting lug 30 may pass through the guide section 24 of the slot 20, and between the entrance section 22 and the lock section 26 for inserting the mounting lug 30 into the slot 20, or removing the mounting lug 30 from within the slot 20. When the rotary lock member 34 is moved to the closed position shown in FIG. 2, the rotary lock member 34 prevents removal of the mounting lug 30 from withing the lock section 26, which secures the mounting lug 30 and the associated drawer to the first slide member 14 and the drawer slide 12. The rotary lock member 34 is preferably normally disposed in the closed position shown in FIG. 2, and selectively moved to the open position shown in FIG. 1 by a user either manually rotating the drawer lock 32 counterclockwise, or applying the weight of the drawer associated with the mounting lug 30 to the rotary lock member 34.

FIG. 2 is a partial perspective view of the forward end of the first slide member 14, and shows the drawer mounting lug 30 disposed within the lock section 24 of the forward slot 20 and the rotary lock member 34 in a closed position for retaining the mounting lug 30 within the slot 20. The rotary lock member 34 has a semicircular, disk-shaped main body portion defining a main lock member body 36 and follower portion defined by a concave, arcuately shaped follower surface 38 formed into a peripheral edge of the lock member body 36. The concave shape of the follower surface 38 faces outward and away from a central portion of the lock member body 36. When the rotary lock member 34 is disposed in the closed position shown in FIG. 2, the follower surface 38 faces upwards, and the lock member body 36 is disposed adjacent the mounting lug 30 to prevent removal of the mounting lug 30 from the lock section 26 of the slot 20. A grip surface 40 is provided by spaced apart recesses formed into in a peripheral edge 45 of the rotary lock member 34 to define spaced apart tabs providing a castellated surface for a portion of the peripheral edge 45. The grip surface 40 is disposed on an opposite end of the peripheral edge 45 of the rotary lock member 34 than the follower surface 38. A user may press against the grip surface 40 to rotate the rotary lock member 34 from the closed position shown in FIG. 2 to the open position shown in FIG. 1, in which the concave shape of the follower surface 38 provides clearance for removal of the mounting lug 30 from within the slot 20.

Figure 3:
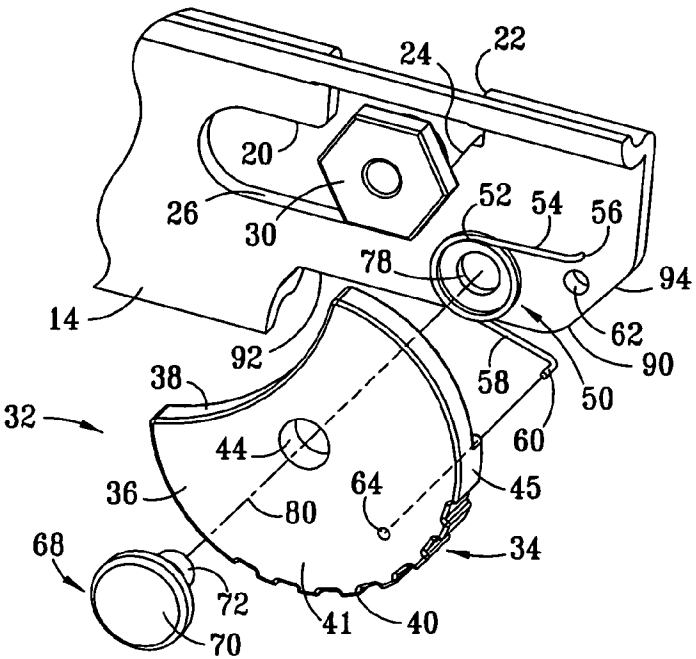
Figure 4:
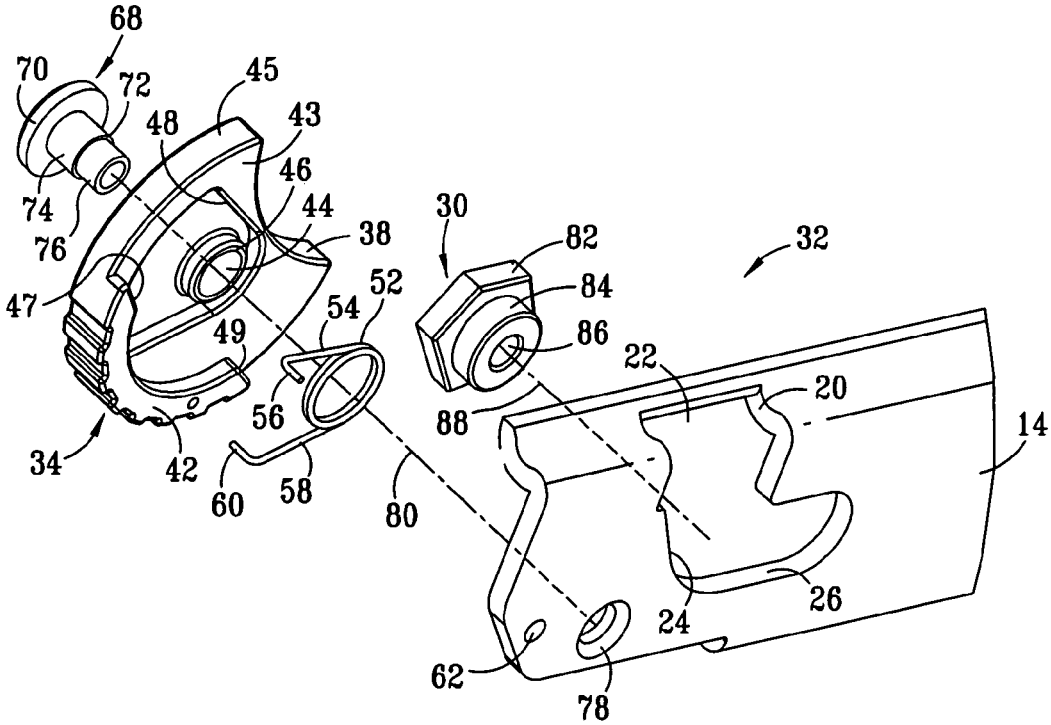

FIGS. 3 and 4 are exploded, partial perspective views of opposite sides of the drawer lock 32 and the forward portion of the first slide member 14. FIG. 3 shows the drawer mounting lug 30 disposed in the guide section 24 of the forward slot 20 in the first slide member 14, and FIG. 4 shows the mounting lug 30 moved outward, removed to the side of the slot 20 as part of the exploded view. The drawer lock 32 includes the rotary lock member 34, a torsion spring 50 and a rivet 68. The rotary lock member 34 preferably has an outward side which is preferably defined by a flat, or planar, outer surface 41, and an inward side having a planar inward surface 43 from which a stop protuberance 42 extends toward the first slide member 14 to provide a rotary stop portion for the rotary lock member 34. The stop protuberance 42 is defined by an arcuately shaped rib which partially extends around the peripheral edge 45 of the rotary lock member 34, for approximately one-third of the circumference of the peripheral edge 45, preferably with an outward edge which is continuous with and flush with the edge periphery of the main lock member body 36. The stop protuberance 42 is disposed on an opposite end of the rotary lock member 34 from the follower surface 38, such that the stop protuberance 42 extends on a substantially diametrically opposite portion of the peripheral edge 45 of the rotary lock member 34 from of the follower surface 38. The forward end of the stop protuberance 42 defines a forward stop portion 47, and the rearward end of the stop protuberance 42 defines a rearward stop portion 49. The tabs defining the grip surface 40 are disposed on a portion of the edge periphery 45 of the rotary lock member 34 which is defined by the peripheral edge of the main body portion 36 and the outward edge periphery of the stop protuberance 42. A mounting hole 44 is formed in the central portion of the lock member body 36 of the rotary lock member 34, perpendicular to the outer surface 41 of the rotary lock member 34. An annular shaped boss 46 extends around an inward portion of the mounting hole 44, such that the inward edge of the boss 46 is flush with or extends slightly beyond the plane of the inward surface 43 to provide a bearing surface for engaging the sidewall of the first slide member 14. A substantially triangular shaped recess 48 extends into the inward surface 43, and around the boss 46. The recess 48 has an outward edge which is arcuately shaped, with a rearward portion of the outward edge extending adjacent to a forward portion of the stop protuberance 42. The recess 48 is provided for receiving the torsion spring 50, and preferably has a depth for enclosing of thickness of the torsion spring 50.

The torsion spring 50 is preferably formed of a section of spring steel wire, and has a central coil portion 52 from which a first spring arm arms 54 and a second spring arm 58 extend from opposite sides of the circumference of the coiled portion 52. The two spring arms 54 and 58 extend tangent to the coiled portion 52 and are shown in FIG. 3 extending in a direction toward the forward end of the first slide member 14. The coil portion 52 is of a diameter for fitting around the boss 46. The terminal end portion of the first spring arm 54 is formed to define a first tab 56 which fits in a locating hole 62 formed into a forward portion of the first slide member 14. The terminal end portion of the second spring arm 54 is formed to provide a second tab 60 which fits into a locating hole 64 formed within the interior portion of the recess 48 in the rotary lock member 34. The torsion spring 50 provides a biasing member for urging the rotary lock member 34 into the closed position, shown in FIG. 2.

A rivet 68 is provided for securing within a mounting hole 78 formed in the forward portion of the first slide member 14, and rotatably secures the rotary lock member 34 to the forward end of first slide member 14. The rivet 68 has a head 70 and a shank 72. The head 70 preferably has a circumferential edge periphery which is round. The shank 72 has a bearing portion 74 and a rivet end 76. The head 70 is preferably larger than the diameter of the mounting hole 44, and the bearing portion 74 is smaller than the diameter of the mounting hole 44. The bearing portion 74 has a larger diameter than the rivet end 76 and the mounting hole 78. The rivet end 76, prior to riveting, has a smaller diameter than the mounting hole 78, and is sized for fitting into and securing within the mounting hole 78, such that an edge of the bearing portion 74 adjacent the rivet end 76 engages the sidewall of the first slide member 14 to provide a clearance between the sidewall of the first slide member 14 and the head 70 of the rivet 68. Preferably, the length of the bearing portion 74, which defines the clearance between the sidewall of the first slide member 14 and the head 70, is larger than the thickness of the rotary lock member 34 at the boss 46, and between the outer surface 41 and the inner surface 43, such that the rotary lock member 34 rotates freely upon the bearing portion 74. The rotary lock member 34, including the mounting hole 44 and the annular-shaped boss 46, the coil portion 52 of the torsion spring 50, and the rivet 68 are coaxially mounted around the axis 80, such that the rotary lock member 34 rotates about the axis 80. Preferably, the axis 80 is disposed orthogonal to the longitudinal length of the drawer slide 12, along which the first slide member 14 extends from within the second slide member 16.

The drawer mounting lug 30 defines a drawer mounting member which projects from the drawer for supporting the drawer in relation to the first slide member 14 and the drawer slide 12. The drawer mounting lug 30 preferably has a head 82 and a shank 84. The head 82 is preferably of a width which is smaller than the width of the entrance section 22 of the slot 20, and larger than the guide section 24 and the lock section 26 of the slot 20. The head 82 is preferably hexagonal shaped, providing flats meeting at edges which define corners for engaging the arcuately shaped follower surface 38 of the rotary lock member 34 along lineally extending contact points, that is, by a contact point engagement which extends in a line that is disposed orthogonal to the arcuate shape, or curve, of the follower surface 38, rather than engaging along an area of surface contact. The present embodiment provides lineal contacts between the head 82 and the follower surface 38 rather than surface area contact portions to reduce the frictional engagement between the mounting lugs 30 and the rotary lock member 34. The shank 84 is of a thickness which is smaller than the width of the slot 20, and provides a bearing portion for supporting weight of the drawer within the slot 20 of the first slide member 14. A mounting hole 86 preferably extends into the shank 84 and through the head 82 for securing the mounting lug 30 to the drawer by means of a fastener (not shown), such as a rivet which is similar to rivet 68, for rotatably securing the head 82 and the shank 84 of the mounting lug 30 to the drawer. In other embodiments, a drawer mounting member may be provided by the mounting lug 30 being non-rotatably secured to the drawer, or by a protuberant portion of the drawer which extends in fixed relation to the drawer.

A lower portion of the forward end first slide member 14 is formed or cut to provide an edge profile 90 having edge portions which define a closed position stop 92 and an open position stop 94. The stop protuberance 42 of the rotary lock member 34 and the stops 92 and 94 defined by the edge profile 90 of the forward end of the first slide member 14 are formed for operating in cooperative relation to locate the rotary lock member 34 in the open position, shown in FIG. 1, and in the closed position, shown in FIG. 2. The stop 92 will engage the rearward stop portion 49 of the stop protuberance 42 to locate the rotary lock member 34 in the closed position, shown in FIG. 6. The stop 94 will engage the forward stop portion 47 of the stop protuberance 42 to locate the rotary lock member 34 in the open position, shown in FIG. 7.

Figure 5:
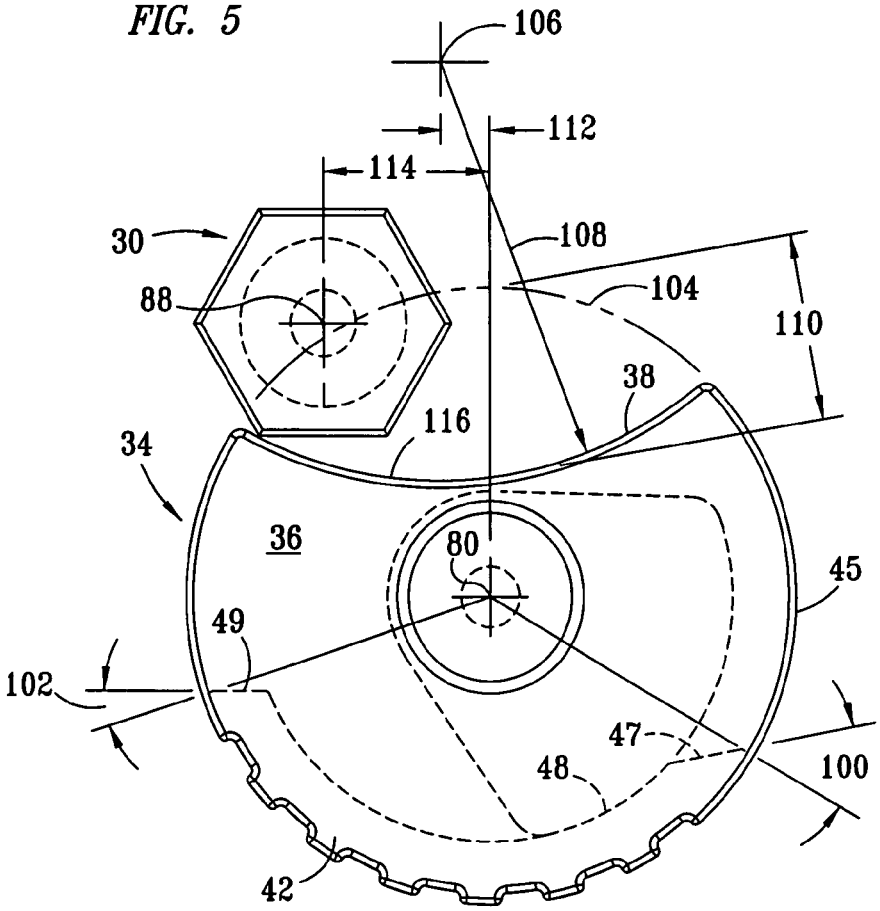

FIG. 5 is a side elevation view of the rotary lock member 34 and the drawer mounting lug 30. The forward stop portion 47 of the stop protuberance 42 is shown extending at an angle 100 to a radial projection from the axis 80, and the rearward stop portion 49 of the stop protuberance 42 is shown extending at an angle 102 to a radial projection from the axis 80. In the preferred embodiment, the angle 102 is smaller than the angle 100, to adapt the terminal ends of the stop protuberance 42 defining the stop portions 49 and 47 for fitting flush against the stops 92 and 94 of the edge profile 90 of the first slide member 14 and operatively engaging the form, or shape, of the edge profile 90. A protection line 104 is an arcuately shaped projection from a convex portion of the edge periphery 45 of the rotary lock member 34 which does not include a concave portion of the edge periphery 45 defined by the follower surface 38. The projection line 104 is representative a portion of a cylindrical surface defined by projection of the convex portion of the peripheral edge 45 of the rotary lock member 34 to extend as a continuous, cylindrical shaped surface for the rotary lock member 34.

In the preferred embodiment, the follower surface 38 is preferably an arcuate surface defined by projection of an arc of radius 108 extending from a center line 106 into the main body portion 36 of the rotary lock member 34 for a distance 110 of approximately one third of the nominal diameter of the rotary lock member 34. In the embodiment shown, the arcuate surface defining the follower surface 38 preferably has a nominal diameter which is greater than the nominal diameter of the rotary lock member 34 defined by the arcuate portion of the peripheral edge 45 and the projection line 104. The centerline 106 for the arcuate follower surface 38 is preferably offset by a distance 112 in a rearward direction from a vertically extending, radial projection from the central axis 80 of the rotary lock member 34 when the rotary lock member 34 is disposed in the closed position. The follower surface 38 is concave and faces outward from the main body 36 of the rotary lock member 44, and has a rearwardly disposed engagement portion 116 which is engaged by the mounting lug 30. The mounting lug 30 initially engages the engagement portion 116 of the follower surface 38 at a rearward most end of the engagement portion 116, with the central axis 88 of the mounting lug 30 spaced apart by a distance 114 in a rearward direction from a vertically extending, radial projection from the central axis 80 of the rotary lock member 34.

Figure 6:
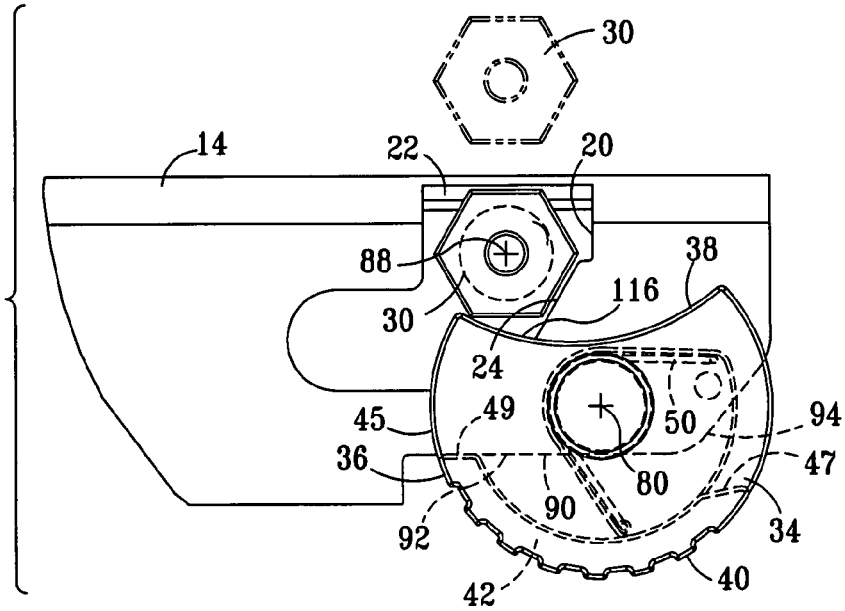
Figure 7:
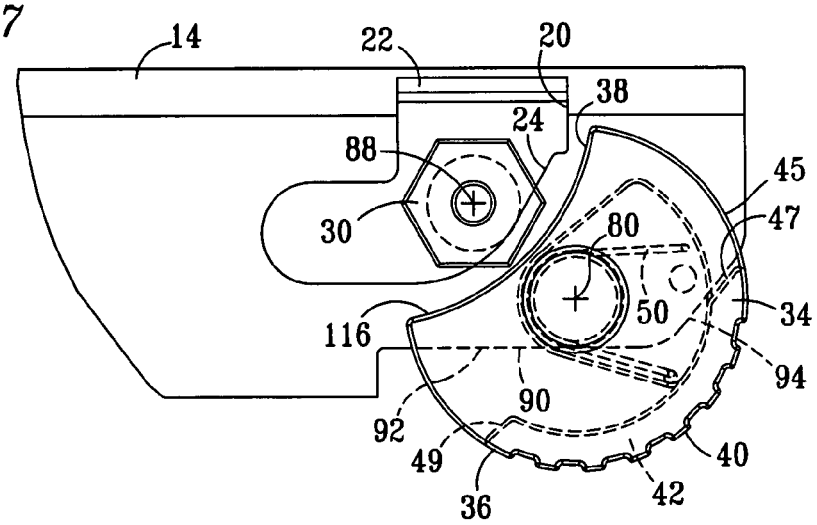
Figure 8:
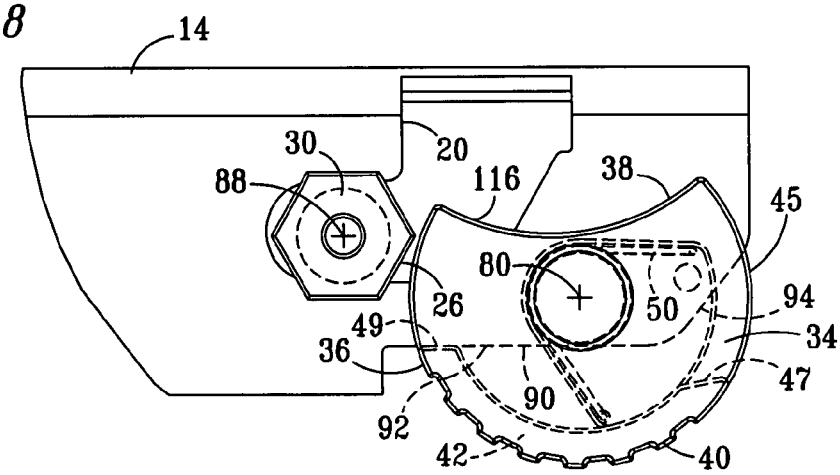

FIGS. 6, 7 and 8 are partial, side elevation views of the first slide member 14, the drawer lock 32 and the drawer mounting lug 30, and show operation of the drawer lock 32 for securing the mounting lug 30 to the first slide member 14 and for releasing the mounting lug 30 for removal from the first slide member 14. FIG. 6 shows the drawer mounting lug 30 in two positions. In the first position, the drawer mounting lug 30 is depicted in phantom, located immediately above the entrance section 22 of the J-shaped slot 20 and the engagement portion 116 of the follower surface 38. In the second position, the drawer mounting lug 30 is depicted in object lines, disposed within the entrance section 22 and the guide section 24 of the J-shaped slot 20, in initial engagement with the engagement portion 116 of the follower surface 38. The rotary lock member 34 is shown in a closed position, with rearward stop portion 47 defined by the rearward end of the annular-shaped stop protuberance 42 engaging flush against the closed stop portion 92 of the edge profile 90 formed in the forward end portion of the first slide member 14. The follower surface 38 of the rotary lock member 34 is disposed in an upward position, such that the engagement portion 116 of the follower surface 38 is disposed beneath the drawer mounting lug 30 for being engaged with the drawer mounting lug 30 and receiving the weight of the drawer applied through the drawer mounting lug 30. The drawer mounting lug 30 engages the engagement portion 116 of the follower surface 38 rearward of the central axis 80, about which the rotary lock member 34 rotates. Weight of a drawer applied through the drawer mounting lug 30 to the follower surface 38 applies a downward force to the rotary lock member 34 rearward of the central axis 80, applying torque for moving the rotary lock member 34 counterclockwise against the biasing force of the torsion spring 50, from the closed position shown in FIG. 6 to the open position show in FIG. 7.

FIG. 7 shows the drawer lock 32 after the rotary lock member 34 has been rotated to the open position, with the forward stop portion stop 47 defined by the forward end of the stop protuberance 42 engaging flush against open stop portion 94 of the edge profile 90. From the position shown in FIG. 7, the drawer mounting lug 30 is free to move rearward from a position adjacent the follower surface 38 of the rotary lock member 34 and into a position located in the lock section 26 of the slot 20, shown in FIG. 8. When disposed in the lock section 26, the drawer mounting lug 30 is located rearward of the follower surface 38 and the rotary lock member 34 is free to return to a closed position, as show in FIG. 8.

FIG. 8 shows the drawer mounting lug 30 after being disposed within the lock section 26 of the slot 20, and the rotary lock member 34 after being urged by the torsion spring 50 to move clockwise, from the open position shown in FIG. 7 to the closed position shown in FIG. 8. When the rotary lock member 23 is in the closed position, the rearward stop portion 49 defined by the rearward end of the stop protuberance 42 is engaging flush against the closed stop portion 92 of the edge profile 90. To remove the mounting lug 30 from within lock section 26 of the J-shaped slot 20, preferably the grip surface 40 is engaged by a user and moved in a forward direction, to rotate the rotary lock member 34 in a counterclockwise angular direction against the force of the torsion spring 50, from the closed position shown in FIG. 8 to the open position shown in FIG. 7. The drawer mounting lug 30 may then be removed from the slot 20 by moving from within the lock section 26, through the guide section 24, and out of the entrance section 22 to the position shown in phantom in FIG. 6.

The present invention provides several advantages over prior art drawer locks. A rotary lock member is rotatably mounted to a drawer slide for rotating under the weight of a drawer applied through a drawer mounting lug the rotary lock member. The rotary lock member moves from a closed position to an open position to allow the drawer mounting lug to pass into a J-shaped mounting slot formed in the drawer slide. Once the drawer mounting member is located in a lock section of the J-shaped mounting slot, a torsion spring moves the rotary lock member from the open position to the closed position, which secures the drawer mounting lug with the J-shaped mounting slot to secure the drawer to the drawer slide. The rotary lock member may later be moved from the closed position to the open position for removal of the drawer mounting lug form within the J-shaped mounting slot, to allow removal of the drawer from the drawer slide.

Although the preferred embodiment has been described in detail, it should be understood that various changes, substitutions and alterations can be made therein without departing from the spirit and scope of the invention as defined by the appended claims.

What is claimed is:

1. In a drawer slide having first slide member and a second slide member, the first slide member being slidably extensible from within the second slide member from a retracted position to an extended position in a cantilevered arrangement, the improvement comprising:

a drawer mounting member;

a slot formed into the first slide member, said slot having an entrance section formed into an edge of the first slide member for receiving said drawer mounting member into said slot, and a lock section for receiving said drawer mounting member from said entrance section;

a rotary lock member having a main body portion, a follower portion and a rotary stop portion, said rotary lock member rotatably mounted to said first slide member for rotating about an axis relative to main body portion between an open position and a closed position, said follower portion facing outward of said main body portion, and said rotary stop portion disposed in cooperative relation to said first slide member for locating said rotary lock member in said open position and said closed position;

a biasing member engaging between the first slide member and said rotary lock member for urging said rotary lock member into said closed position;

said main body portion and said follower portion adapted such that when said rotary lock member is disposed in said closed position, said main body portion extends adjacent said drawer mounting member and prevents removal of said drawer mounting member from said lock section of said slot, and said follower portion extends adjacent to said entrance section of said slot disposed to engage said drawer mounting member when disposed in said entrance section of said slot, such that movement of said drawer mounting member from said entrance section into said lock section of said slot rotates said rotary lock member from said closed position to said open position, against said biasing member; and said main body portion and said follower portion adapted such that when said rotary lock member is disposed in said open position, said main body portion is moved aside of said drawer mounting member and said follower portion is aligned adjacent said slot for passing said drawer lock member from said entrance section into said lock section of said slot, and said follower portion extends aside of said drawer lock member when disposed in said lock section of said slot, such that said biasing member returns said rotary lock member to said closed position with said main body portion disposed adjacent to said drawer mounting member;

wherein said rotary stop portion has a forward stop and a rearward stop which engages a forward edge of said first slide member which is formed to define an edge profile having an open position stop and a rearward position stop engaged by respective ones of said forward stop and said rearward stop portion of said rotary stop portion.

2. The drawer slide according to claim 1, wherein said rotary stop portion protrudes from a portion of said main body portion of said rotary lock member on an edge of said main body portion opposite said follower portion.

3. The drawer slide according to claim 1, wherein said rotary lock member has an edge periphery with a portion having protuberances which define a grip surface.

4. The drawer slide according to claim 3, wherein said protuberances defining said grip surface comprise tabs aligned along said edge periphery to define a castellated surface.

5. The drawer slide according to claim 1, further comprising a recess formed into said main body portion of said rotary lock member for receiving said bias member.

6. The drawer slide according to claim 5, wherein said bias member comprises a torsion spring having a spring coils from which extends a first arm portion and a second arm portion, said first arm portion engaging said rotary lock member and said second arm portion engaging said first slide member.

7. The drawer slide according to claim 1, wherein said main body portion of said rotary lock member defines a substantially round, disk shaped member and said follower portion defines a cutout portion into said substantially round, disk shaped member.

8. The drawer slide according to claim 7, wherein said cutout portion defined by said follower portion is arcuately shaped and has a cutout radius which is greater than a radius of said substantially round, disk shaped member defined by said main body portion of said rotary lock member, and first vertical protection from a centerline of said cutout portion is disposed rearward of said axis about which said rotary lock member rotates.

9. A drawer slide having a drawer slide member which is slidably extensible from a retracted position to an extended position, the drawer slide comprising:

a drawer mounting lug;

a slot formed into the drawer slide member, said slot having an entrance section formed into an edge of the drawer slide member for receiving said mounting lug into said slot, and a lock section for receiving said mounting lug from said entrance section;

a rotary lock member rotatably mounted to the drawer slide member adjacent said slot, said rotary lock member having a main body portion, a follower portion and a rotary stop portion, wherein said follower portion faces outward of said main body portion and said rotary stop portion is disposed in cooperative relation to said follower portion for locating said follower portion relative to said slot and said drawer mounting lug in a closed position and an open position;

a biasing member engaging the first slide member and said rotary lock member for urging said rotary lock member to move to said closed position;

said main body portion and said follower portion adapted such that when said rotary lock member is disposed in said closed position, said main body portion extends adjacent said drawer mounting lug and prevents removal of said drawer mounting lug from said lock section of said slot, and said follower portion extends adjacent to said entrance section of said slot and includes an engagement portion which engages said drawer mounting lug when disposed in said entrance section of said slot, with said engagement portion disposed in offset relation to a projection from said axis about which said rotary lock member rotates such that movement of said drawer mounting lug from said entrance section into said lock section of said slot rotates said rotary lock member from said closed position to said open position, against said biasing member; and said main body portion and said follower portion adapted such that when said rotary lock member is disposed in said open position, said main body portion is moved aside of said drawer mounting lug and said follower portion is aligned adjacent said slot for passing said drawer lock member from said entrance section into said lock section of said slot, and said follower portion extends aside of said drawer lock member when disposed in said lock section of said slot, such that said biasing member returns said rotary lock member to said closed position with said main body portion disposed adjacent to said drawer mounting lug;

wherein said main body portion of said rotary lock member defines a substantially round, disk shaped member and said follower portion defines a cutout portion into said substantially round, disk shaped member.

10. The drawer slide according to claim 9, wherein said rotary stop portion protrudes from an inward surface of said main body portion of said rotary lock member, disposed along an edge periphery of said main body portion and opposite said follower portion.

11. The drawer slide according to claim 10, further comprising:

said drawer slide member has an edge profile defining a fully closed stop portion and a fully open stop portion, land said rotary stop portion; and said rotary stop portion defining an arcuately shape rib having opposite ends for engaging said fully closed stop portion and said fully open stop portion of said edge profile of said drawer slide to locate said rotary lock member relative to said slot in said drawer slide member.

12. The drawer slide according to claim 11, wherein said rotary lock member has an edge periphery with a portion having protuberances which define a grip surface.

13. The drawer slide according to claim 12, wherein said protuberances defining said grip surface comprise tabs aligned along said edge periphery to define a castellated surface.

14. The drawer slide according to claim 13, further comprising a recess formed into said main body portion of said rotary lock member for receiving said bias member.

15. The drawer slide according to claim 14, wherein said bias member comprises a torsion spring having a spring coils from which extends a first arm portion and a second arm portion, said first arm portion engaging said rotary lock member and said second arm portion engaging said first slide member.

16. The drawer slide according to claim 9, wherein said cutout portion defined by said follower portion is arcuately shaped and has a cutout radius which is greater than a radius of said substantially round, disk shaped member defined by said main body portion of said rotary lock member, and first vertical protection from a centerline of said cutout portion is disposed rearward of said axis about which said rotary lock member rotates.

17. A drawer slide having a drawer slide member which is slidably extensible from a retracted position to an extended position, the drawer slide comprising:

a drawer mounting lug;

a slot formed into the drawer slide member, said slot having an entrance section formed into an edge of the drawer slide member for receiving said mounting lug into said slot, and a lock section for receiving said mounting lug from said entrance section;

a rotary lock member rotatably mounted to the drawer slide member adjacent said slot, said rotary lock member having a main body portion, a follower portion and an arcuately shaped rib, said follower portion facing outward of said main body portion and said rotary stop portion is disposed in cooperative relation to said follower portion for locating said follower portion relative to said slot and said drawer mounting lug when said rotary lock member is disposed in a closed position and an open position;

said arcuately shaped rib protruding from an inward surface of said main body portion of said rotary lock member, said arcuately shape rib having opposite ends for engaging a fully closed stop portion and a fully open stop portion of an edge profile of said drawer slide to locate said rotary lock member relative to said slot and the drawer slide member in said closed position and in said open position;

a biasing spring engaging the first slide member and said rotary lock member for urging said rotary lock member to move to said closed position;

said rotary lock member having an edge periphery with a portion having a plurality protuberances which define a grip surface;

said main body portion and said follower portion adapted such that when said rotary lock member is disposed in said closed position, said main body portion extends adjacent said drawer mounting lug and prevents removal of said drawer mounting lug from said lock section of said slot, and said follower portion extends adjacent to said entrance section of said slot and includes an engagement portion which engages said drawer mounting lug when disposed in said entrance section of said slot, with said engagement portion disposed in offset relation to a projection from said axis about which said rotary lock member rotates such that movement of said drawer mounting lug from said entrance section into said lock section of said slot rotates said rotary lock member from said closed position to said open position, against said biasing member; and said main body portion and said follower portion adapted such that when said rotary lock member is disposed in said open position, said main body portion is moved aside of said drawer mounting lug and said follower portion is aligned adjacent said slot for passing said drawer lock member from said entrance section into said lock section of said slot, and said follower portion extends aside of said drawer lock member when disposed in said lock section of said slot, such that said biasing member returns said rotary lock member to said closed position with said main body portion disposed adjacent to said drawer mounting lug.

18. The drawer slide according to claim 17, further comprising said main body portion of said rotary lock member defining a substantially round, disk shaped member and said follower portion defines a cutout portion into said substantially round, disk shaped member, wherein said cutout portion defined by said follower portion is arcuately shaped and has a cutout radius which is greater than a radius of said substantially round, disk shaped member defined by said main body portion of said rotary lock member, and first vertical protection from a centerline of said cutout portion is disposed rearward of said axis about which said rotary lock member rotates.

* * * * *